United States Patent [19]

Birch

[11] 4,125,201

[45] Nov. 14, 1978

[54] CLOSURE CAP

[75] Inventor: Ralph W. Birch, Rustington, England

[73] Assignee: U.M.P. Plastics Limited, Lancashire, England

[21] Appl. No.: 849,792

[22] Filed: Nov. 9, 1977

[30] Foreign Application Priority Data

Nov. 25, 1976 [GB] United Kingdom ..... 49226/76

[51] Int. Cl.[2] ..... B65D 41/04

[52] U.S. Cl. ..... 215/330; 215/341; 215/344

[58] Field of Search ..... 215/330, 341, 344

[56] References Cited

U.S. PATENT DOCUMENTS

| | | | |
|---|---|---|---|
| 2,162,880 | 6/1939 | Brown | 215/330 |
| 3,297,185 | 1/1967 | Plymale | 215/330 |
| 3,405,831 | 10/1968 | Hudson | 215/330 |
| 3,682,345 | 8/1972 | Baugh | 215/330 |
| 3,784,041 | 1/1974 | Birch | 215/344 |

FOREIGN PATENT DOCUMENTS

| | | | |
|---|---|---|---|
| 2,124,100 | 11/1972 | Fed. Rep. of Germany | 215/341 |
| 1,303,436 | 1/1973 | United Kingdom | 215/341 |

*Primary Examiner*—Ro E. Hart

*Attorney, Agent, or Firm*—Cushman, Darby & Cushman

[57] ABSTRACT

A closure cap adapted to seal the neck of a container, the closure cap having a top portion and an annular skirt which extends from the periphery of the top portion, the skirt being provided internally with a skirt thread which is adapted to cooperate with an external neck thread on the neck of the container, the skirt also being provided internally with a radially extending resilient annular thread flange which is disposed immediately adjacent to and on the same helix as the skirt thread and is disposed on the side of the skirt thread facing the open end of the skirt, the thread flange, when undeformed, extending substantially radially inwardly of the skirt thread with a gap therebetween, the thread flange, when the closure cap is fully screwed onto the neck resiliently engaging the outer wall of the neck to effect centralization and resist loosening of the closure cap, the thread flange being forced by the neck towards the skirt thread so as to reduce said gap.

16 Claims, 9 Drawing Figures

CLOSURE CAP

Figure 1:
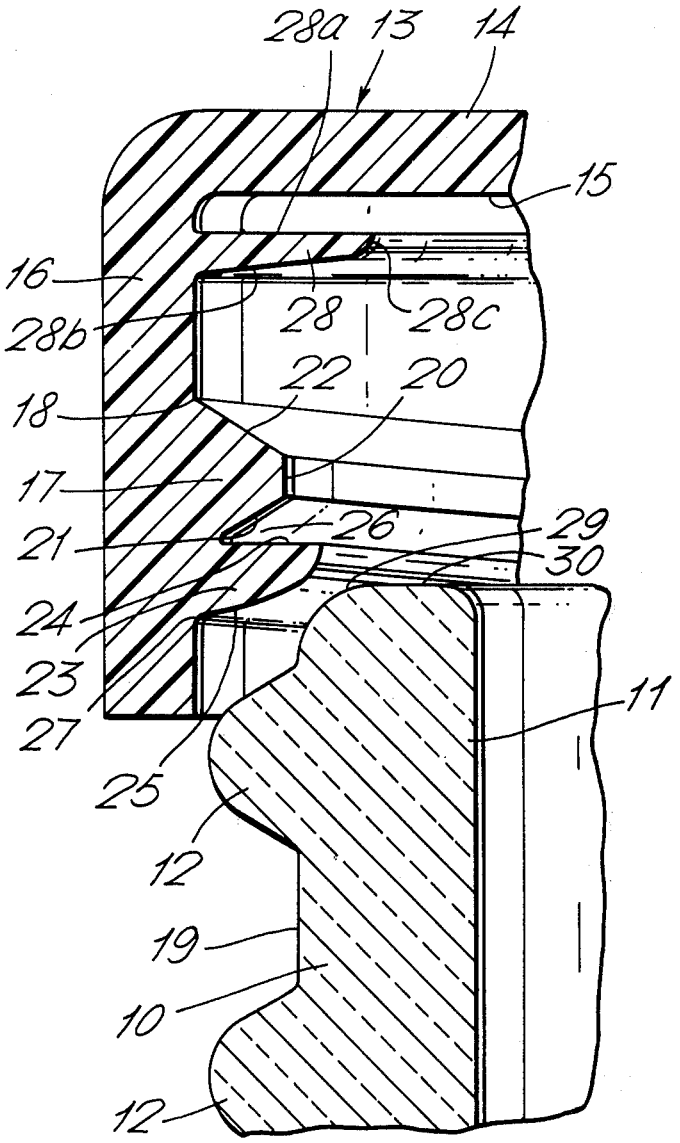

This invention concerns both a container whose neck is sealed by a closure cap, and a closure cap therefor.

An attempt has been made in the past to devise a closure cap for a container which requires considerable torque to remove it from the container, so as to ensure that the closure cap does not become loose during storage or transit. Such an attempt, however, has involved providing interference between threads on the closure cap and container, and this has in turn produced radial bulging of the closure cap which may, in certain circumstances, detract from sealing effectiveness and is unsightly.

According to the present invention, there is provided a closure cap adapted to seal the neck of a container, the closure cap having a top portion and an annular skirt which extends from the periphery of the top portion, the skirt being provided internally with a skirt thread which is adapted to cooperate with an external neck thread on the neck of the container, the skirt also being provided internally with a radially extending resilient annular thread flange which is disposed immediately adjacent to and on the same helix as the skirt thread and is disposed on the side of the skirt thread facing the open end of the skirt, the thread flange, when undeformed, extending substantially radially inwardly of the skirt thread with a gap therebetween, and the arrangement being such that when the closure cap is fully screwed onto the neck, the thread flange resiliently engages the outer wall of the neck to effect centralisation and resist loosening of the closure cap, the thread flange being forced by the neck towards the skirt thread so as to reduce or eliminate said gap.

According to another aspect of the present invention, to which also the invention is in no way restricted, there is provided a container having a neck provided externally with a neck thread, and a closure cap which is screwed into the neck and which has a top portion and an annular skirt which extends from the periphery of the top portion, the skirt being provided internally with a skirt thread which cooperates with the neck thread, the skirt also being provided internally with a radially extending resilient annular thread flange which is disposed immediately adjacent to and on the same helix as the skirt thread and is disposed on the side of the skirt thread facing the open end of the skirt, the thread flange resiliently engaging the outer wall of the neck to effect centralisation and resist loosening of the closure cap, and the thread flange having been forced by the neck from an undeformed position, in which it extends substantially radially inwardly of the skirt thread with a gap therebetween, towards the skirt thread so as to reduce or eliminate said gap.

The closure cap may also be provided with a sealing flange which seals against the neck of the container.

The sealing flange is preferably a radially extending annular sealing flange which seals against the rim of the neck of the container, the sealing flange being disposed between the skirt thread and the said top portion, and the sealing flange extending radially inwardly of the skirt thread.

The sealing flange and rim preferably have corresponding curved surfaces so that, when the closure cap is screwed onto the neck, an initial line contact occurs therebetween.

Preferably the skirt thread at its root extends through an axial distance exceeding that through which the thread flange extends at its root. The gap may extend radially throughout the greater part of the distance between the root and crest of the skirt thread.

Alternatively the gap may extend radially throughout the radially innermost portion only of the skirt thread.

The skirt thread preferably has a straight sided profile in cross section. Moreover, the skirt thread may have leading and trailing flanks which are substantially at right angles to each other.

The thread flange may have a straight sided trailing flank in cross section.

The trailing flanks of the skirt thread and thread flange may be substantially parallel to each other.

The thread flange, when undeformed and axially aligned with but spaced from the container, may extend radially inwardly of the outer wall of the neck by between 0.15 mm and 0.45 mm.

The skirt thread at its root may extend through an axial distance of between 1.5 mm and 2.05 mm.

The thread flange at its root may extend through an axial distance of between 0.63 mm and 0.76 mm.

Preferably, there is one complete turn only of the thread flange.

Figure 2:
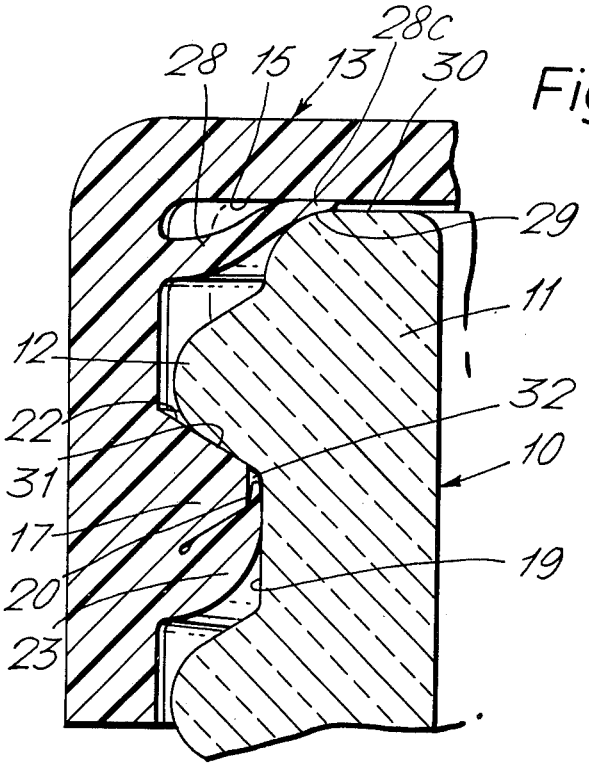
Figure 3:
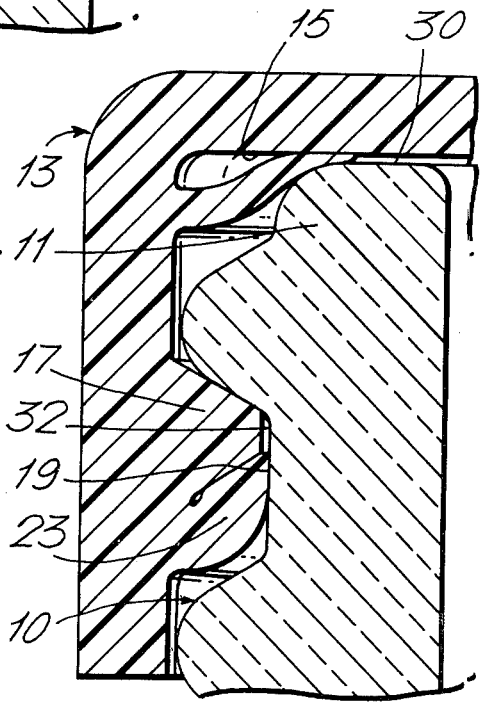
Figure 4:
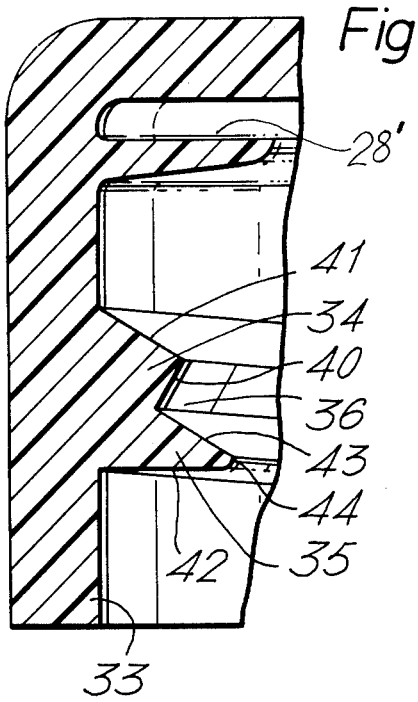
Figure 5:
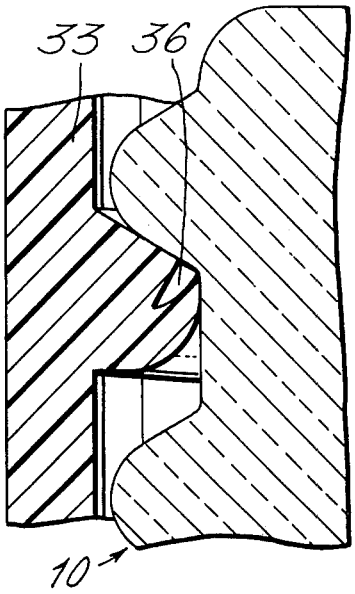
Figure 6:
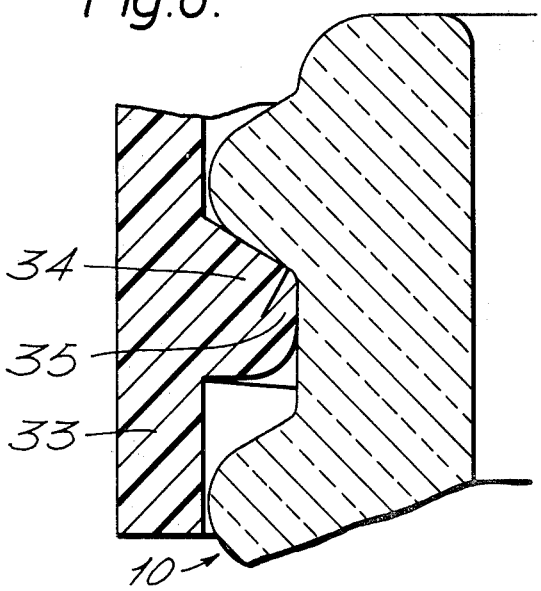
Figure 7:
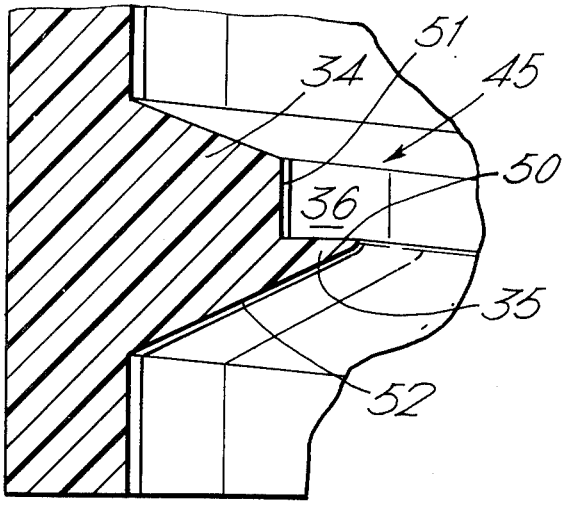
Figure 8:
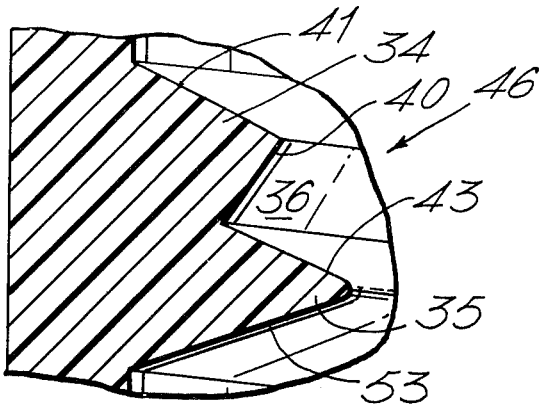
Figure 9:
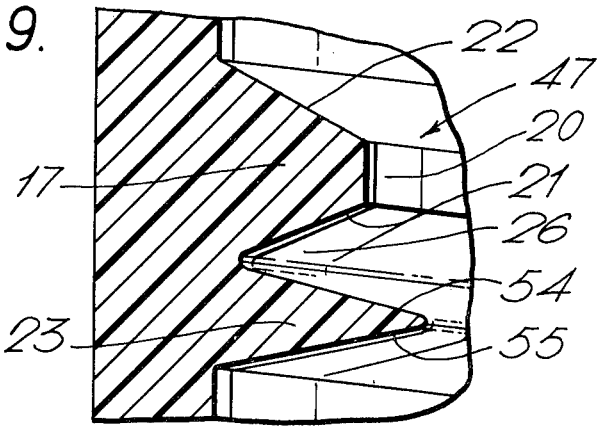

The invention is illustrated, merely by way of an example, in the accompanying drawings, in which:

FIG. 1 is a broken-away cross-sectional view of a container and a closure cap therefor, the closure cap being shown in the position immediately before it is screwed onto the container, FIG. 2 is a broken-away cross-sectional view showing the closure cap of FIG. 1 screwed fully onto a container having minimum acceptable external dimensions, FIG. 3 is a broken-away cross-sectional view showing the closure cap of FIG. 1 screwed fully onto a container having maximum acceptable external dimensions, FIG. 4 is a broken-away cross-sectional view of another embodiment of a closure cap according to the present invention, FIG. 5 is a broken-away cross-sectional view showing a part of the closure cap of FIG. 4 screwed fully onto a container having minimum acceptable external dimensions, FIG. 6 is a broken-away cross-sectional view showing the closure cap of FIG. 4 screwed onto a container having maximum acceptable external dimensions, FIGS. 7, 8 and 9 are broken-away cross-sectional views of further embodiments of closure caps according to the present invention.

In FIG. 1 there is shown a container 10, of glass or other material, having a neck 11 provided externally with a thread 12 of conventional rounded profile. The neck 11 is adapted to be sealed by a closure cap 13. The closure cap 13 is adapted to be screwed onto the neck 11 as shown in FIG. 2, but is shown in FIG. 1 as being spaced from the neck 11 but axially aligned therewith.

The closure cap 13 is an integral injection moulding of an elastomeric material such, for example, as polypropylene. The closure cap 13 has a top portion 14 having a flat internal surface 15 and an annular skirt 16 which extends from the periphery of the top portion 14.

The skirt 16 is provided internally with a thread 17 which cooperates with the thread 12 of the neck 11 to retain the closure cap 13 on the container 10. The thread 17 has a straight sided profile in cross-section having, in cross-section, a flat axially extending crest 20 and flat leading and trailing flanks 21, 22 which extend at equal obtuse angles, e.g. of 120°, to the crest 20. The thread 17 at its root 18 extends through an axial distance between 1.5 mm and 2.05 mm. The crest 20 of the thread 17 has a diameter between 0.05 mm and 0.1 mm greater than that of the outer wall 19 of the neck 11 to provide the necessary clearance to enable the closure cap 13 to be screwed onto the neck 11.

The skirt 16 is also provided internally with a radially extending resilient annular thread flange 23 which is disposed immediately adjacent to the thread 17, is on the same helix as the thread 17, and is disposed on the side of the thread 17 facing the open end of the skirt 16. The thread flange 23 has a straight sided trailing flank 24 in cross section which, in the undeformed position of the thread flange 23 shown in FIG. 1, extends parallel to the internal surface 15 of the top portion 14. The thread flange 23 also has a leading flank 25 which is curved in cross section. The thread flange 23, when undeformed and axially aligned with but spaced from the container 11 as shown in FIG. 1, extends radially inwardly of the outer wall 19 of the neck 11 by between 0.15 mm and 0.45 mm. Thus, when so undeformed, the thread flange 23 extends radially inwardly of the crest 20 of the thread 17 to a substantial extent so that, as the closure cap 13 is screwed down onto the neck 11, the thread flange resiliently engages the outer wall 19 so as to centralise the closure cap 13 on the neck 11, while when the closure cap 13 is screwed fully onto the neck 11, the resilient engagement of the thread flange 23 with the outer wall 19 resists loosening of the closure cap 13.

The thread flange 23, at its root 27, extends through an axial distance of between 0.63 mm and 0.76 mm, so that the thread 17 at its root 18 extends through an axial distance exceeding that through which the thread flange 23 extends at its root 27. For this reason, and because, when undeformed, the thread flange 23 extends radially inwardly of the crest 20 to a substantial extent, the thread flange 23 is resilient whereas the thread 17 is substantially non-resilient, so that the thread 17 remains substantially undeformed even when the thread flange 23 is deformed.

The thread flange 23, when undeformed, is spaced from the thread 17 by a gap 26 which extends radially throughout the greater part of the radial distance between the root 18 and crest 20 of the thread 17.

There is preferably one complete turn only of the thread flange 23 since if further turns are provided it can be very difficult to screw the closure cap 13 down onto the neck 11.

The closure cap 13 is also provided with an annular sealing flange 28 which extends radially inwardly from the skirt 16 and is disposed between the thread 17 and the top portion 14. The sealing flange 28, which extends radially inwardly of the thread 17, has a flat surface **28*a* which extends parallel to and is spaced from the internal surface 15 of the top portion 14, a surface 28*b* which faces the open end of the skirt 16 and which extends radially inwardly from the skirt 16 so as to slope towards the internal surface 15, and a curved or arcuate surface 28*c* which joins the surfaces 28*a*, 28*b*. The curved surface 28*c* of the sealing flange 28, as described in greater detail in U.S. Pat. No. 3,784,041, is adapted when the closure cap 13 is screwed onto the neck 11, to make an initial circular line contact with a curved surface 29 at the rim of the neck 11** so that a primary seal is effected therebetween.

The closure cap 13 is designed for use with a container 10 whose external dimensions may vary by ±0.33 mm due to manufacturing tolerances. In FIG. 2 the closure cap 13 is shown as being screwed fully onto the neck 11 of a container 10 having the minimum acceptable external dimensions. As the closure cap 13 is screwed down, the curved surfaces **28*c*, 29 are brought into an initial line contact to effect an initial or primary seal and then, as the closure cap 13 is screwed further down the sealing flange 28 is forced into contact with a greatly increased area of the neck 11, such area including part of the flat radially extending surface 30 at the top of the neck 11**, whereby to make a secondary seal therewith. By reason, however, of the fact that the primary seal occurs along a circular line only high sealing effectiveness is produced.

As will be appreciated, however, the best possible sealing effectiveness will only be realised if the closure cap 13 is accurately centralised coaxially in relation to the container neck 11 since otherwise an uneven distribution of the available sealing pressure will occur being greater on one side of the neck 11 than on the other. The need to allow clearance between a closure cap and a container neck, due to manufacturing tolerances, invariably permits some sideways movement of the closure when tightened with consequent failure to achieve accurate co-axial centralisation. It is in this respect that the thread flange 23 is very important since once the closure cap 13 has been screwed down sufficiently to engage the outer wall 19 of the neck 11, the engagement therebetween centralises the closure cap 13 with respect to the neck 11 and thus aligns them in such a way that the best possible seal is achieved, whereby to ensure that there is even sealing pressure all round.

As the closure cap 13 is screwed down onto the neck 11, moreover, the neck 11 has forced the thread flange 23 towards the thread 17 so as substantially to eliminate the gap 26, the radially innermost part of the thread flange 23 resiliently engaging the outer wall 19 and being forced into a space 32 between the crest 20 and the outer wall 19. The provision of the thread flange 23 very substantially increases frictional resistance to the loosening of the closure cap 13 after it has been screwed onto the container 10, without causing any signifcant bulging of the skirt 16 as a result.

In FIG. 3 the closure cap 13 is shown as being screwed fully onto the neck 11 of a container 10 having maximum acceptable external dimensions. As will be seen from FIG. 3, the disposition of the parts is very similar to that shown in FIG. 2 except that, since the space 32 is in this case at a minumum, the thread flange 23 does not necessarily enter the space 32 but assumes a more bulbous configuration than in the FIG. 2 arrangement. Here again, however, the thread flange 23 extends somewhat radially inwardly of the crest 20, so that it resiliently engages the outer wall 19 to resist loosening of the closure cap 13 and to effect centralisation of the closure cap 13 with respect to the neck 11.

As will be seen, when the parts are disposed as shown in FIG. 2 or in FIG. 3, the thread 17 and thread flange 23 engage each other so as to form, in effect, a single thread.

In FIG. 4 there is shown part of a modified closure cap 33 having a thread 34 and a thread flange 35. The closure cap 33 also has a sealing flange 28' corresponding to the sealing flange 28. The thread 34 is spaced from the thread flange 35 by a gap 36 which extends radially throughout the radially innermost portion only of the thread 34.

The thread 34 has a straight sided profile in cross section having leading and trailing flanks 40, 41 which are substantially at right angles to each other. The thread flange 35 has leading and trailing flanks 42, 43 which are flat in cross-section and joined together by a radiused crest 44. The leading flank 42 extends perfectly radially, whereas the trailing flank 43 is substantially parallel to the trailing flank 41.

FIG. 5 shows the closure cap 33 screwed fully onto a container 10 having the minimum acceptable external dimensions As will be seen, the effect is substantially the same as in FIG. 2 except that the gap 36, although substantially reduced in size by comparison with its size in FIG. 4, is not eliminated.

FIG. 6 shows the closure cap 33 screwed fully onto a container 10 having the maximum acceptable external dimensions. As will be seen, the effect is substantially the same as in FIG. 3, but in this case the gap 36 virtually disappears so that the thread 34 and thread flange 35 become in effect one single thread.

In FIGS. 7, 8 and 9 there are respectively shown broken-away cross-sectional views of closure caps 45, 46, 47 according to the present invention. The portions of the closure caps 45, 46, 47 shown in the drawings do not include a sealing flange corresponding to the sealing flange 28, but it should be clearly understood that each of the closure caps 45, 46, 47 may, if desired, incorporate such a sealing flange.

The closure caps 45, 46 of FIGS. 7 and 8 are generally similar to the closure cap 33 of FIG. 4, while the closure cap 45 of FIG. 9 is generally similar to the closure cap 13 of FIG. 1, and for this reason the closure caps 45, 46, 47 will not be described in detail, like references indicating like parts.

In the case of the closure cap 45, however, the thread flange 35 has a radially extending trailing flank 50 which is at right angles to an axially extending crest 51 of the thread 34, the thread flange 35 having a leading flank 52 which slopes radially inwardly towards the top portion (not shown) of the closure cap 45.

In the case of the closure cap 46, the construction is the same as that of the closure cap 33 of FIG. 4 except that the thread flange 35 has a leading flank 53 which slopes radially inwardly towards the top portion (not shown) of the closure cap 46.

In the case of the closure cap 47, the construction is the same as that of the closure cap 13 of FIG. 1 except that the thread flange 23 has a trailing flange 54 and a leading flange 55 which respectively slope radially inwardly away from and towards the top portion (not shown) of the closure cap 47.

I claim:

1. A closure cap adapted to seal the neck of a container, the closure cap having a top portion and an annular skirt which extends from the periphery of the top portion, the skirt being provided internally with a skirt thread which is adapted to cooperate with an external neck thread on the neck of the container, the skirt also being provided internally with a radially extending resilient annular thread flange which is disposed immediately adjacent to and on the same helix as the skirt thread and is disposed on the side of the skirt thread facing the open end of the skirt, the thread flange, when undeformed, extending substantially radially inwardly of the skirt thread with a gap therebetween, the thread flange, when the closure cap is fully screwed onto the neck resiliently engaging the outer wall of the neck to effect centralisation and resist loosening of the closure cap, the thread flange being forced by the neck towards the skirt thread so as to reduce said gap.

2. A container having a neck provided externally with a neck thread, and a closure cap which is screwed onto the neck and which has a top portion and an annular skirt which extends from the periphery of the top portion, the skirt being provided internally with a skirt thread which cooperates with the neck thread, the skirt also being provided internally with a radially extending resilient annular thread flange which is disposed immediately adjacent to and on the same helix as the skirt thread and is disposed on the side of the skirt thread facing the open end of the skirt, the thread flange resiliently engaging the outer wall of the neck thread to effect centralisation and resist loosening of the closure cap, and the thread flange having been forced by the neck from an undeformed position, in which it extends substantially radially inwardly of the skirt thread with a gap therebetween, towards the skirt thread so as to reduce or eliminate said gap.

3. A container as claimed in claim 2 in which the closure cap is also provided with a sealing flange which seals against the neck of the container.

4. A container as claimed in claim 3 in which the sealing flange is a radially extending annular sealing flange which seals against the rim of the neck of the container, the sealing flange being disposed between the skirt thread and the said top portion, and the sealing flange extending radially inwardly of the skirt thread.

5. A container as claimed in claim 4 in which the sealing flange and rim have corresponding curved surfaces, an initial line contact occurring therebetween when the closure cap is screwed onto the neck.

6. A container as claimed in claim 2 in which the skirt thread at its root extends through an axial distance exceeding that through which the thread flange extends at its root.

7. A container as claimed in claim 2 in which the gap extends radially throughout the greater part of the distance between the root and crest of the skirt thread.

8. A container as claimed in claim 2 in which the gap extends radially throughout the radially innermost portion only of the skirt thread.

9. A container as claimed in claim 2 in which the skirt thread has a straight sided profile in cross section.

10. A container as claimed in claim 9 in which the skirt thread has leading and trailing flanks which are substantially at right angles to each other.

11. A container as claimed in claim 2 in which the thread flange has a straight sided trailing flank in cross section.

12. A container as claimed in claim 11 in which the trailing flanks of the skirt thread and thread flange are substantially parallel to each other.

13. A container as claimed in claim 2 in which the thread flange, when undeformed and axially aligned with but spaced from the container, extends radially inwardly of the outer wall of the neck by between 0.15 mm and 0.45 mm.

14. A container as claimed in claim 2 in which the skirt thread at its root extends through an axial distance of between 1.5 mm and 2.05 mm.

15. A container as claimed in claim 2 in which the thread flange at its root extends through an axial distance of between 0.63 mm and 0.76 mm.

16. A container as claimed in claim 2 in which there is one complete turn only of the thread flange.

* * * * *